United States Patent [19]

Wimmer

[11] Patent Number: 5,031,589

[45] Date of Patent: Jul. 16, 1991

[54] SAFETY DEVICE FOR PREVENTING THE LOSS OF CONTAINER CLOSURE PLUGS

[75] Inventor: Max Wimmer, Pocking, Fed. Rep. of Germany

[73] Assignee: Motorenfabrik Hatz GmbH & Co. KG, Ruhstorf, Fed. Rep. of Germany

[21] Appl. No.: 351,026

[22] Filed: May 12, 1989

[30] Foreign Application Priority Data

May 16, 1988 [DE] Fed. Rep. of Germany ..... 3816586

[51] Int. Cl.[5] ..... F02M 1/16

[52] U.S. Cl. ..... 123/187.5 R; 123/1 A; 123/180 P; 220/375; 222/386

[58] Field of Search ..... 220/375; 215/306; 184/38.1, 88.1, 28; 222/543, 386, 387, 319; 123/187.5 R, 180 P

[56] References Cited

U.S. PATENT DOCUMENTS

| | | | |
|---|---|---|---|
| 464,306 | 12/1891 | Lunkenheimer | 184/28 |
| 495,535 | 4/1893 | Walker | 184/88.1 |
| 734,036 | 7/1903 | Bennett | 184/88.1 |
| 1,162,803 | 12/1915 | Parves | 123/180 P |
| 1,581,818 | 4/1926 | Sheffield et al. | 220/375 |
| 1,638,941 | 8/1927 | Lea | 184/88.1 |
| 2,170,756 | 8/1939 | Lehwald | 220/375 X |
| 2,877,920 | 3/1959 | Densow . | |
| 4,573,602 | 3/1986 | Goldberg | 215/306 X |

FOREIGN PATENT DOCUMENTS

| | | | |
|---|---|---|---|
| 0141611 | 5/1985 | European Pat. Off. . | |
| 0152171 | 8/1985 | European Pat. Off. . | |
| 21700 | 9/1896 | United Kingdom | 222/386 |
| 7679 | 3/1912 | United Kingdom | 222/386 |
| 231113 | 3/1925 | United Kingdom . | |

*Primary Examiner*—Stephen Marcus

*Attorney, Agent, or Firm*—Flynn, Thiel, Boutell & Tanis

[57] ABSTRACT

A safety device for preventing the loss of a container closure plug, comprising a retaining member disposed on, and preferably secured to, the container, and a spiral to which the closure plug is connected and which surrounds the said closure plug several times, the retaining member, spiral and closure plug or a part to which the spiral is attached and which is itself fastened to the closure plug being integrally made from a plastics material which allows resilient deformation of the spiral. The closure plug includes a piston portion which is received in the interior of the container to displace a selected quantity of fluid therein into an inlet opening to an induction manifold of an engine.

22 Claims, 1 Drawing Sheet

SAFETY DEVICE FOR PREVENTING THE LOSS OF CONTAINER CLOSURE PLUGS

FIELD OF THE INVENTION

The invention relates to a safety device for preventing the loss of a closure plug for a container.

BACKGROUND OF THE INVENTION

There is always a considerable risk that a closure plug may be lost and the container can no longer be closed after use. This circumstance is very disadvantageous, particularly when the container forms part of a device which is highly susceptible to soiling or the like, for example a metering device for an auxiliary fluid for facilitating the starting of an internal combustion engine.

An object of the present invention is to avoid this disadvantage.

SUMMARY OF THE INVENTION

In accordance with the invention, a retaining member is disposed on, preferably secured to, the container, and the closure plug is connected to the retaining member by means of a spiral which surrounds the closure plug several times, the retaining member, spiral and closure plug being integrally made from a material, preferably a plastics material, which allows resilient deformation of the spiral.

When using a safety device of this type on a metering device for an auxiliary fluid for facilitating the starting of an internal combustion engine, it is particularly advantageous if the closure plug is at the same time in the form of a pressure piston by means of which the auxiliary fluid is delivered from the interior of the metering device through the air-induction pipe of the engine up to a point upstream of the inlet valve.

It is particularly advantageous to design the closure plug in such a way that it comprises a piston portion which is displaceable in the interior of the metering device, and an outer ring which forms part of the spiral and which is rigidly connected to the piston portion.

BRIEF DESCRIPTION OF THE DRAWINGS

The invention is further described, by way of example, with reference to the accompanying drawings, in which.

DETAILED DESCRIPTION

A metal cylinder 12 is sealingly and tightly screwed into an opening in a flange 10 forming part of an air-induction pipe (not illustrated) of an internal combustion engine. An overflow tube 14 is seated in the interior of the cylinder and communicates with a bore 10*a* of the opening which is formed in the flange 10 and which leads into the interior of the air-induction pipe. A retaining ring 16*h* is rigidly seated on a reduced end 12*a* of the cylinder 12 and is manufactured as an integral plastics element together with a multiple turn spiral 16*s* and an outer ring 16*a*. The elasticity, particularly the elasticity of the spiral 16*s*, must be sufficiently great after the injection-moulding process to ensure that the spiral can be resiliently bent, stretched and compressed.

The outer ring 16*a* is rigidly connected to a piston portion 16*k*, for example shrunk onto, or welded to, the piston portion. The piston portion 16*k* may be made from harder, inelastic plastics material or from some other material. The piston portion 16*k* carries sealing rings 18 on its circumference.

Figure 1:
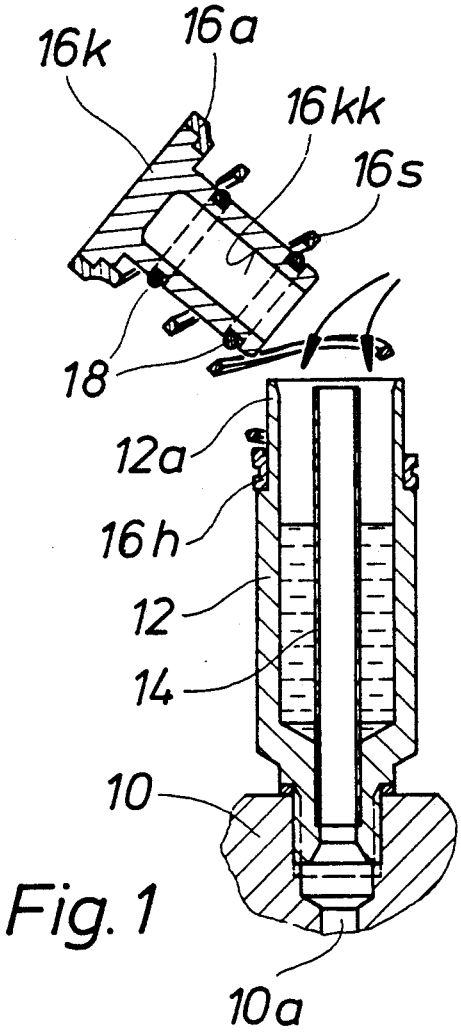
FIG. 1 is a sectional view of a metering device with its closure plug held open.
Figure 2:
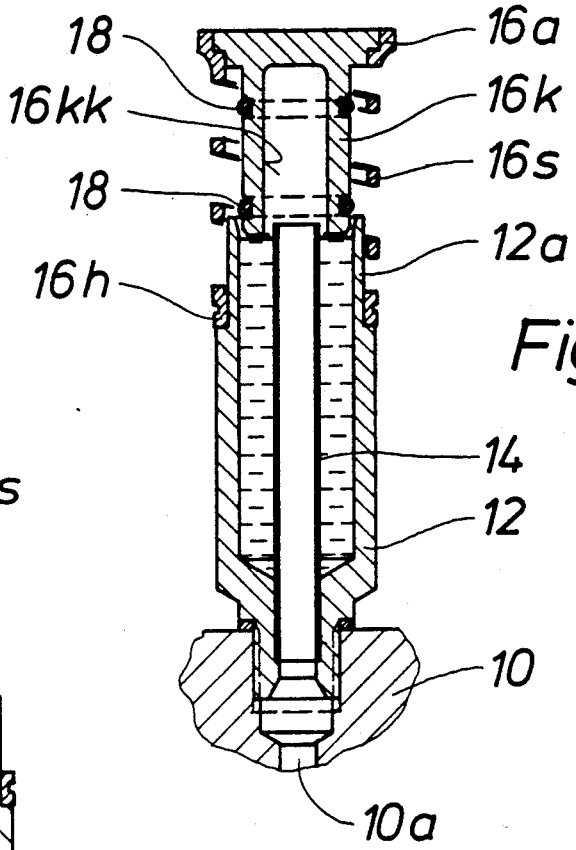
FIG. 2 shows the same device with the closure plug applied.
Figure 3:
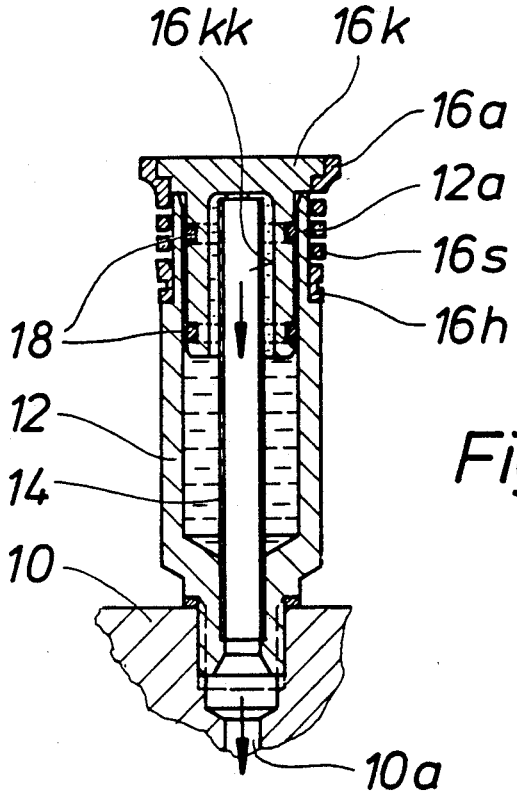
FIG. 3 shows the metering device during a metering operation.

FIG. 1 shows the piston portion 16*k* in the state in which it has been withdrawn from the cylinder 12. The operator can then introduce a metered quantity of auxiliary fluid (such as thin-bodied lubricating oil used in the engine in winter into the interior of the cylinder. The level of the fluid in the cylinder 12 then rises to the level shown in FIG. 2. The operator then places the piston portion 16*k*, 16*a* onto the cylinder 12 and presses the piston portion downwardly (FIG. 3). There then remains between the blind bore 16*kk* in the piston portion 16*k* and the periphery of the tube 14 a gap of adequate size through which, upon depressing the piston portion 16*k* into the interior of the cylinder 12 to displace the auxiliary fluid, the auxiliary fluid can flow from the interior of the cylinder 12, through the interior of the tube 14, and through the bore 10*a* into the air-induction pipe and then to a point upstream of the inlet valve.

When starting the internal combustion engine, this metered quantity of auxiliary fluid will enter the engine cylinder and then considerably facilitate the starting operation during the winter months.

By virtue of the integral construction of the elements 16*h*, 16*s*, 16*k*, it is ensured that the closure plug is not lost. Hence, the metering device is always closed after use, so that impurities or the like cannot enter the interior of the engine cylinder by way of the open metering device.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An apparatus comprising: a container having an interior which can hold a fluid and having first and second openings which each communicate with said interior; a closure plug having a portion removably insertable into said first opening in said container; and a flexible holding member which connects said closure plug to said container; wherein said portion of said closure plug is a pressure piston and movement of said pressure piston in said first opening forces fluid out of the interior of said container through said second opening, wherein said container includes a tube which extends into and communicates with the interior of said container, wherein said pressure piston includes means defining therein a blind bore, a portion of said tube being received in said blind bore when said pressure piston is inserted in said first opening of said container, wherein said tube provides fluid communication between the interior of said container and said second opening, and wherein said blind bore includes an inner surface which extends around and is spaced from an outer surface of said portion of said tube when said portion of said tube is received in said blind bore, said outer surface and said inner surface having a gap therebetween which permits fluid flow from the interior of said container into said tube.

2. The apparatus according to claim 1, wherein said flexible holding member includes a retaining ring fixedly connected to said container, an outer ring fixedly connected to said closure plug, and an elongate, resiliently deformable helical portion which connects said retaining ring and said outer ring.

3. The apparatus according to claim 2, wherein said resiliently deformable helical portion includes multiple turns which extend around said closure plug.

4. The apparatus according to claim 2, wherein said flexible holding number is made from a plastic material, and said retaining ring, said outer ring, and said helical portion are all formed integrally with one another.

5. The apparatus according to claim 1, wherein said container has a substantially cylindrical hole of uniform diameter extending thereinto, said interior of said container and said first opening being respective portions of said hole, and said second opening communicating with said hole at an inner end of said hole, said tube extending axially into said hole from said inner end thereof.

6. The apparatus according to claim 5, wherein said tube is cylindrical and disposed substantially concentrically within said hole.

7. The apparatus according to claim 5, wherein said pressure piston of said closure plug is substantially cylindrical and has in a cylindrical outer surface thereof two circumferential grooves, and including two annular sealing rings which encircle said pressure piston, which are each disposed in a respective said groove, and which are each slidably sealingly engagable with an inner surface of said cylindrical hole.

8. The apparatus according to claim 7, wherein said flexible holding member includes a helical portion which has an inside diameter greater than the outside diameter of and which concentrically encircles said pressure piston, said helical portion having one end coupled to said container and the other end coupled to an end portion of said closure plug provided at a first end of said pressure piston, said blind bore opening into said pressure piston from a second end thereof remote from said first end.

9. The apparatus according to claim 8, wherein said container includes an end portion having a cylindrical outer surface with an outside diameter less than the inside diameter of said helical portion of said holding member, and wherein said holding member includes a retaining ring tightly encircling said cylindrical outer surface on said container and an outer ring tightly encircling said end portion of said closure plug, said ends of said helical portion being respectively fixedly connected to said retaining ring and said outer ring.

10. The apparatus according to claim 9, wherein said end portion of said closure plug has a diameter greater than the diameter of said pressure piston.

11. An apparatus comprising an internal combustion engine in combination with a container having an interior which can hold a fluid and having first and second openings which each communicate with said interior, a closure plug having a portion removably insertable into said first opening in said container, and a flexible holding member which connects said closure plug to said container; wherein said portion of said closure plug is a pressure piston and movement of said pressure piston in said first opening forces fluid out of the interior of said container through said second opening, said internal combustion engine having a suction passageway, said container and said engine being operatively coupled and said second opening being in fluid communication with said suction passageway, and including an overflow tube which is arranged in the interior of said container and which communicates with said second opening and with the interior of said container; wherein said overflow tube, upon movement of said pressure piston, facilitates fluid transfer from the interior of said container through said second opening to said suction passageway.

12. The apparatus according to claim 11, wherein said first opening in said container is a cylindrical bore, wherein said pressure piston includes at least one packing ring on the periphery thereof which is engagable with said bore, and wherein said packing ring, upon movement of said pressure piston, prevents fluid from exiting from the interior of said container through said first opening.

13. The apparatus according to claim 11, wherein said pressure piston includes means defining therein a blind bore, a portion of said overflow tube being received in said blind bore when said pressure piston is inserted in said first opening of said container, and wherein said blind bore includes an inner surface which extends around and is spaced from an outer surface of said portion of said tube when said portion of said tube is received in said blind bore, said outer surface and said inner surface having a gap therebetween which permits fluid flow from the interior of said container into said tube.

14. The apparatus according to claim 13, wherein said flexible holding member includes a retaining ring fixedly connected to said container, an outer ring fixedly connected to said closure plug, and an elongate, resiliently deformable helical portion which connects said retaining ring and said outer ring.

15. The apparatus according to claim 14, wherein said resiliently deformable helical portion includes multiple turns which extend around said closure plug.

16. The apparatus according to claim 4, wherein said flexible holding member is made from a plastic material, and said retaining ring, said outer ring, and said helical portion are all formed integrally with one another.

17. The apparatus according to claim 13, wherein said container has a substantially cylindrical hole of uniform diameter extending thereinto, said interior of said container and said first opening being respective portions of said hole, and said second opening communicating with said hole at an inner end of said hole, said tube extending axially into said hole from said inner end thereof.

18. The apparatus according to claim 17, wherein said tube is cylindrical and disposed substantially concentrically within said hole.

19. The apparatus according to claim 17, wherein said pressure piston of said closure plug is substantially cylindrical and has in a cylindrical outer surface thereof two circumferential grooves, and including two annular sealing rings which encircle said pressure piston, which are each disposed in a respective said groove, and which are each slidably sealingly engageable with an inner surface of said cylindrical hole.

20. The apparatus according to claim 19, wherein said flexible holding member includes a helical portion which has an inside diameter greater than the outside diameter of and which concentrically encircles said pressure piston, said helical portion having one end coupled to said container and the other end coupled to an end portion of said closure plug provided at a first end of said pressure piston, said blind bore opening into said pressure piston from a second end thereof remote from said first end.

21. The apparatus according to claim 20, wherein said container includes an end portion having a cylindrical outer surface with an outside diameter less than the inside diameter of said helical portion of said holding member, and wherein said holding member includes a retaining ring tightly encircling said cylindrical outer surface on said container and an outer ring tightly encircling said end portion of said closure plug, said ends of said helical portion being respectively fixedly connected to said retaining ring and said outer ring.

22. The apparatus according to claim 21, wherein said end portion of said closure plug has a diameter greater than the diameter of said pressure piston.

* * * * *

UNITED STATES PATENT AND TRADEMARK OFFICE

CERTIFICATE OF CORRECTION

PATENT NO. : 5 031 589

DATED : July 16, 1991

INVENTOR(S) : Max Wimmer

It is certified that error appears in the above-identified patent and that said Letters Patent is hereby corrected as shown below:

Column 3, line 13; change "number" to ---member---.

Column 4, line 40; change "4" to ---14---.

Signed and Sealed this

Sixteenth Day of February, 1993

*Attest:*

STEPHEN G. KUNIN

*Attesting Officer*

*Acting Commissioner of Patents and Trademarks*